US005903812A

United States Patent [19]

Kondoh et al.

[11] Patent Number: 5,903,812

[45] Date of Patent: May 11, 1999

[54] RECYCLE DOCUMENT FEEDER INCLUDING A RECIPROCALLY MOVABLE PARTITIONING UNIT

[75] Inventors: Kazuhisa Kondoh; Toru Tanjoh; Jun Kusakabe; Hiroshi Kobayashi; Hiroyuki Harada; Masaki Deguchi; Masahiro Sako; Shigeo Kurando, all of Osaka, Japan

[73] Assignee: Mita Industrial Co., Ltd., Osaka, Japan

[21] Appl. No.: 08/971,963

[22] Filed: Nov. 17, 1997

[30] Foreign Application Priority Data

Nov. 27, 1996 [JP] Japan ..... 8-316641
Nov. 28, 1996 [JP] Japan ..... 8-318246

[51] Int. Cl.[6] ..... G03G 15/00

[52] U.S. Cl. ..... 399/373; 271/220; 271/223

[58] Field of Search ..... 399/367, 373, 399/376, 377; 271/175, 220, 223

[56] References Cited

U.S. PATENT DOCUMENTS 5,084,741 1/1992 Takemura et al. ..... 399/373
5,244,200 9/1993 Manzke ..... 271/220 X
5,338,018 8/1994 Nagao et al. ..... 399/367 X

*Primary Examiner*—S. Lee
*Attorney, Agent, or Firm*—Smith, Gambrell & Russell, Beveridge, Degrandi, Weilacher & Young Intellectual Property Group

[57] ABSTRACT

A recycle document feeder includes a partitioning unit (17) and action plates (19, 20). The partitioning unit (17) includes a partitioning bar (18). When the partitioning bar (18) is lowered, the leading edges of discharged document originals are stopped by the partitioning bar (18). The action plates (19, 20) guide the discharged document originals toward an upper side of the trailing edges of document originals yet to be fed, and push the trailing edges of the discharged document originals to transport the document originals for re-feeding thereof. The partitioning unit (17) and the action plates (19, 20) are driven by a common motor (47). Further, a partitioning unit driving mechanism (110) and an action plate driving mechanism (111) are provided for driving the partitioning unit (17) and the action plates (19, 20), respectively.

13 Claims, 13 Drawing Sheets

DOCUMENT RECYCLE
COMPLETION OF COPYING OPERATION
17
102
103
30
D
D1
Dn
18
19.20
11.12
13
14
1

RECYCLE DOCUMENT FEEDER INCLUDING A RECIPROCALLY MOVABLE PARTITIONING UNIT

This invention is based on applications Nos. 8-316641 and 8-318246 filed in Japan, the contents of which are incorporated hereinto by reference.

BACKGROUND OF THE INVENTION

1. Field of the Invention

The present invention relates to a recycle document feeder which is mounted on an image forming apparatus such as a copying machine, a facsimile machine, an image reader or the like, and adapted to feed a document original to be read by the image forming apparatus from a document placing plate to a reading position and then back onto the document placing plate after image reading of the document original.

2. Description of Related Art

Recycle document feeders are conventionally known which are mounted on a copying machine, for example, and adapted to automatically feed a document original previously set on a document placing plate onto a contact glass of the copying machine and then back onto the document placing plate after image reading of the document original.

Such a recycle document feeder typically has means for dividing document originals fed back onto the document placing plate from a stack of document originals previously set on the document placing plate for prevention of needless re-feeding of the document originals once subjected to the feeding operation.

The recycle document feeder further includes means for transporting the document originals fed back onto the document placing plate to a predetermined setting position on the document placing plate when the document originals are to be fed again, and means for neatly arranging the document originals already subjected to the feeding operation so as to allow the document originals to be readily removed from the document placing plate.

However, the conventional document dividing mechanism and document arranging mechanism each have a complicated structure. In addition, these mechanisms respectively require driving devices, thereby increasing the size and cost of the document feeder.

SUMMARY OF THE INVENTION

It is a principal object of the present invention to provide a smaller-size recycle document feeder which can divide document originals once subjected to a document feeding operation from document originals yet to be subjected to the document feeding operation and prevent the document originals once subjected to the document feeding operation from being randomly arranged.

It is another object of the present invention to provide a recycle document feeder which can neatly arrange document originals fed back onto its document placing plate and features a reduced size and a reduced cost.

A recycle document feeder according to the present invention comprises a partitioning unit for stopping leading edges of document originals fed back onto a document placing plate, and an action plate for guiding the document originals fed back onto the document placing plate and transporting the document originals toward a predetermined setting position. The partitioning unit and the action plate cooperate to neatly arrange the document originals fed back onto the document placing plate for re-feeding thereof.

Further, the document originals are properly transported on the document placing plate for the re-feeding thereof.

The partitioning unit and the action plate are driven by a common motor, so that the size and cost of a driving mechanism can be reduced.

DESCRIPTION OF THE PREFERRED EMBODIMENTS

A recycle document feeder for a copying machine will hereinafter be described in detail as one embodiment of the present invention. It should be understood that the present invention is not limited to the recycle document feeder for the copying machine, but is applicable to a recycle document feeder for a facsimile machine and a recycle document feeder for an image reader to be connected to a computer and the like.

Figure 1:
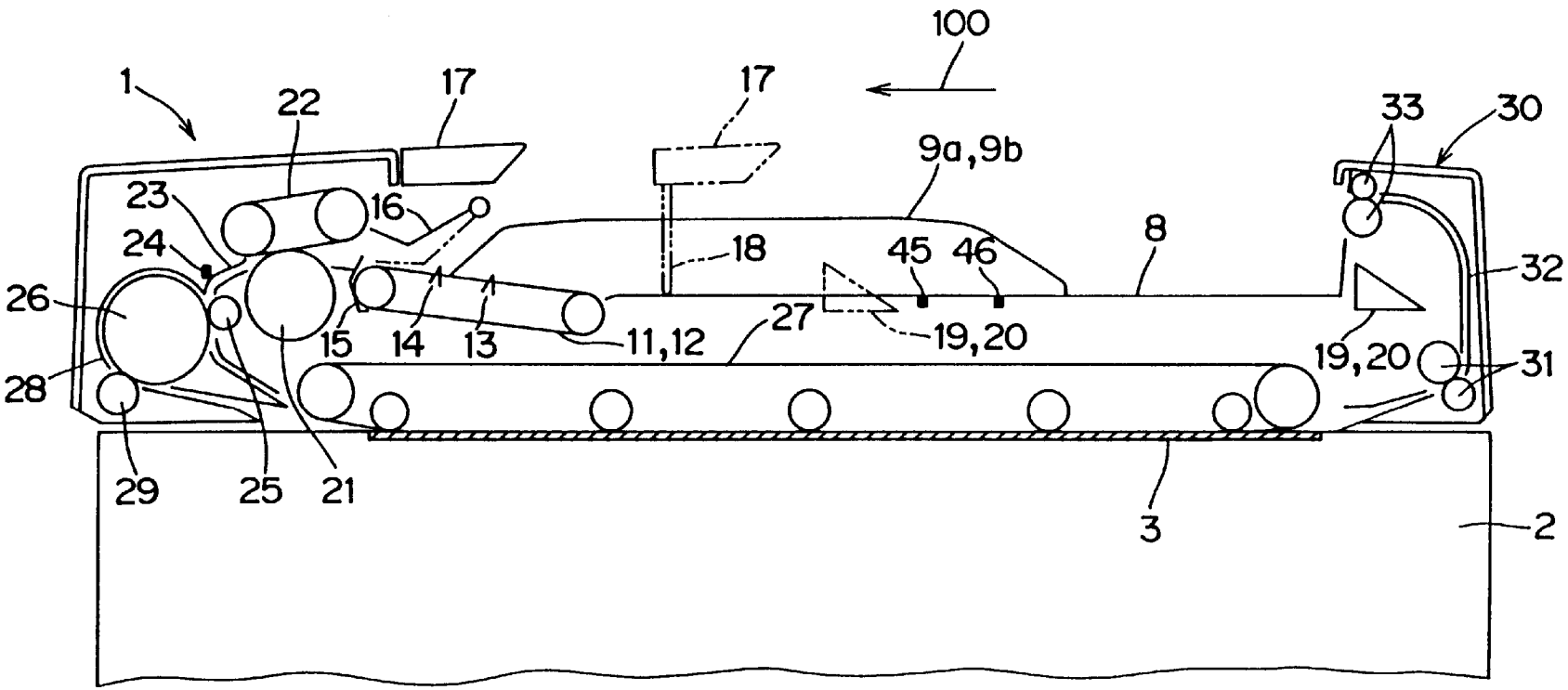
FIG. 1 is a sectional view schematically illustrating the inside construction of a recycle document feeder according to one embodiment of the present invention as viewed from its front side.
Figure 2:
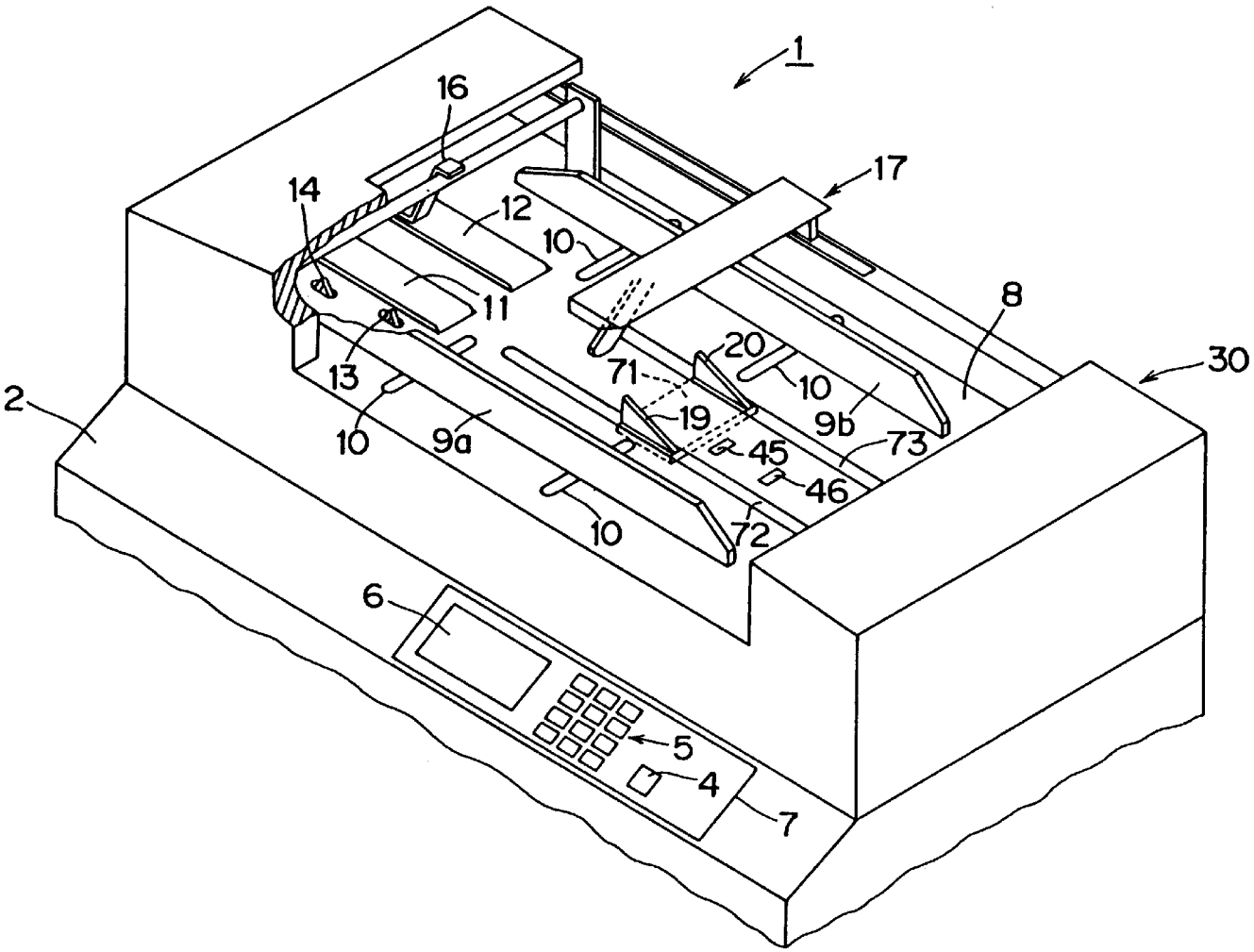
FIG. 2 is a partially cutaway perspective view of the recycle document feeder shown in FIG. 1.

FIG. 1 is a sectional view schematically illustrating the inside construction of the recycle document feeder according to the embodiment of the present invention as viewed from its front side. FIG. 2 is a partially cutaway perspective view of the recycle document feeder shown in FIG. 1.

Referring generally to FIG. 1 and occasionally to FIG. 2, the recycle document feeder 1 is rested on the upper face of a copying machine body 2, and adapted to automatically feed a document original onto a contact glass 3 provided on the upper face of the copying machine body 2 and then back to the original position after image reading thereof. The document original thus fed back to the original position is allowed to be fed again onto the contact glass 3. The recycle document feeder 1 also serves as a cover of the contact glass 3, which is adapted to be opened upward pivotally about the rear edge of the recycle document feeder 1 to expose the contact glass 3 on which a document original can manually be placed.

Provided on a front top face of the copying machine body 2 is an operation panel 7 having operation keys such as a print key 4 and ten-keys 5 and a display portion 6 arranged thereon. The copying machine body 2 and the recycle document feeder 1 are operated through the operation panel 7.

A document placing plate 8 for holding thereon a stack of document originals to be fed onto the contact glass 3 is provided in the center of the upper face of the recycle document feeder 1. The document placing plate 8 is capable of accepting document originals having a B5 (JIS Column B No. 5) size to an A3 (JIS Column A No. 3) size, for example. On the document placing plate 8 is provided a pair of document width regulating guides 9*a* and 9*b* for positioning the stack of document originals placed on the document placing plate 8 relative to a direction perpendicular to a document feeding direction (relative to the width of the document stack). The document width regulating guides 9*a* and 9*b* are adapted to be moved toward and away from each other along a rail 10 in an interlocked relation, and is manually operated so as to conform to the width of the document stack placed on the document placing plate 8.

Two feed belts 11 and 12 for guiding the stack of document originals placed on the document placing plate 8 to a predetermined setting position and starting the feeding of the document originals are provided adjacent to the document placing plate 8. More specifically, the two feed belts 11 and 12 are disposed in a parallel relation perpendicular to the document transportation direction.

A preset switch 13 for sensing that the document originals are placed on the document placing plate 8 is provided on an upstream side of the feed belt 11. When a user places a stack of document originals on the document placing plate 8, the preset switch 13 is turned on to start driving the feed belts 11 and 12. The stack of document originals placed on the document placing plate 8 is transported in the direction of an arrow 100 (leftward as seen in FIG. 1) by the driving of the feed belts 11 and 12.

A set switch 14 is provided downstream of the preset switch 13 relative to the document transportation direction. The driving of the feed belts 11 and 12 are stopped after a lapse of a predetermined time period from a time point at which the set switch 14 is turned on by the transported document stack. Thus, the stack of document originals is set in the predetermined setting position.

A leading edge stopping member 15 for stopping the leading edges of the document originals set in place is provided downstream of the feed belts 11 and 12 to prevent the document originals from being inserted downstream of the setting position in the document transportation direction. Further, the leading edge stopping member 15 prevents a user unfamiliar with the handling of the document feeder from inadvertently inserting document originals downstream of the setting position in the document transportation direction.

When the print key 4 on the copying machine body 2 is pressed with the document originals thus set in place, a partitioning unit 17 previously located in its home position (as indicated by a solid line in FIG. 1) above the feed belts 11 and 12 is moved in a direction opposite to the document transportation direction by a certain distance corresponding to the size of the document originals so as to be located in a position as indicated by a two-dot-and-dash line in FIG. 1. The partitioning unit 17 includes a partitioning bar 18, which can be shifted between an inactive state where it is retracted within the partitioning unit 17 and an active state where it stops the leading edges of document originals fed back onto the document placing plate 8. When the document originals are subjected to a document feeding operation, the partitioning bar 18 is lowered to assume the active state, whereby the leading edges of document originals fed back onto the document placing plate 8 through a document discharge portion 30 (which will be described later) are aligned and the document originals subjected to the document feeding operation are divided from the document originals yet to be subjected to the document feeding operation.

Further, two action plates 19 and 20 previously located in their home positions (as indicated by a solid line in FIG. 1) within the document discharge portion 30 are moved in the document transportation direction by a distance, which depends on the size of the document originals set in place, so as to be located in a position as indicated by a two-dot-and-dash line in FIG. 1. The action plates 19 and 20 are coupled by a coupling plate 71 below the document placing plate 8 (see FIG. 2), and adapted to be moved in unison along guide rails 72 and 73 extending in a direction perpendicular to the document transportation direction in a spaced relation on the document placing plate 8.

The action plates 19 and 20 are each comprised of a generally right-angled triangular planar plate having an edge inclined upward toward the document transportation direction as viewed in a direction perpendicular to the direction of their movement. Therefore, a first document original is guided by the inclined edges of the action plates 19 and 20 and to be fed back onto the document placing plate 8 so that the leading edge of the document original is prevented from bumping against the trailing edges of the document originals set in the setting position and rested thereon.

A mechanism for sensing the size of the document originals and a driving mechanism for driving the partitioning unit 17 and the action plates 19 and 20 will be detailed later.

A pressing member 16 provided above the feed belt 12 is shifted from an upper position as indicated by a solid line to a lower position as indicated by a two-dot-and-dash line in FIG. 1 thereby to press the leading edge of the document stack set in the setting position against the feeding belt 12. The leading edge stopping member 15 is lowered, and the driving of the feed belts 11 and 12 is then started to make the document feeding operation.

A separator roller 21 is disposed downstream of the leading edge stopping member 15 relative to the document transportation direction, and a separator belt 22 is opposed to the separator roller 21. The lowermost one of the document originals (in the document stack) fed by the feed belts 11 and 12 is separated from the other document originals and fed into a document transportation path.

The document original fed into the document transportation path 23 reaches a resist switch 24 provided in the document transportation path 23 thereby to turn on the resist switch 24. After a lapse of a predetermined time period from the turn-on of the resist switch 24, the driving of the feed belts 11 and 12, the separator roller 21 and the separator belt 22 is stopped. At this time, the leading edge of the document original fully abuts against a nipping position between a resist roller 25 and a resist/reverse roller 26, whereby the leading edge portion of the document original has a certain degree of slack. This prevents the document original from being transported at an angle with respect to the document transportation path 23 (so-called slant document feeding).

Thereafter, the transportation of the document original is resumed by starting the rotative driving of the resist roller 25 and the resist/reverse roller 26 in association with the operation of the copying machine body 2. The resist roller 25 and the resist/reverse roller 26 are rotated at a relatively low speed within a predetermined time period after the start of the driving thereof and, thereafter, rotated at a relatively high speed. The predetermined time period for the low-speed rotation is defined as a time period sufficient to absorb the slack of the leading edge portion of the document original. Since the slack of the leading edge portion of the document original is gradually eliminated, an audible sound which may be generated when the slack leading edge portion is abruptly stretched taut (a pop which may be generated when paper is abruptly tensed) is not generated.

The document original transported by the resist roller 25 and the resist/reverse roller 26 is placed in a predetermined position on the contact glass 3 of the copying machine body 2 by a transportation belt 27. Where only an image on one side of the document original is to be read, a document image reading operation is performed by the copying machine in this state. Conversely, where images on both sides of the document original are to be read, the document original is reversed before the image reading operation.

More specifically, the document original placed on the contact glass 3 is taken back into a reversing path 28 by the transportation belt 27. The document original thus taken back is transported through the reversing path 28 by the transportation belt 27, the resist/reverse roller 26, a reverse roller 29 and the resist roller 25, and placed on the contact glass 3 again by the transportation belt 27. Then, the document original is subjected to the image reading operation by the copying machine so that the image on the back side of the document original is first read. Thereafter, the document original is reversed again, and the image on the front side of the document original is read.

If the back side and front side of the document original are not subjected to the image reading operation in this order but in the reverse order, the document reversing operation is performed only once.

The document original subjected to the image reading operation is transported to the document discharge portion 30 by the transportation belt 27. The document original transported to the document discharge portion 30 is further transported through a discharging path 32 by a discharge roller pair 31, and then discharged onto the document placing plate 8 by a discharged roller pair 33. Thus, the document original subjected to the image reading operation is fed back onto the document placing plate 8.

Figure 3:
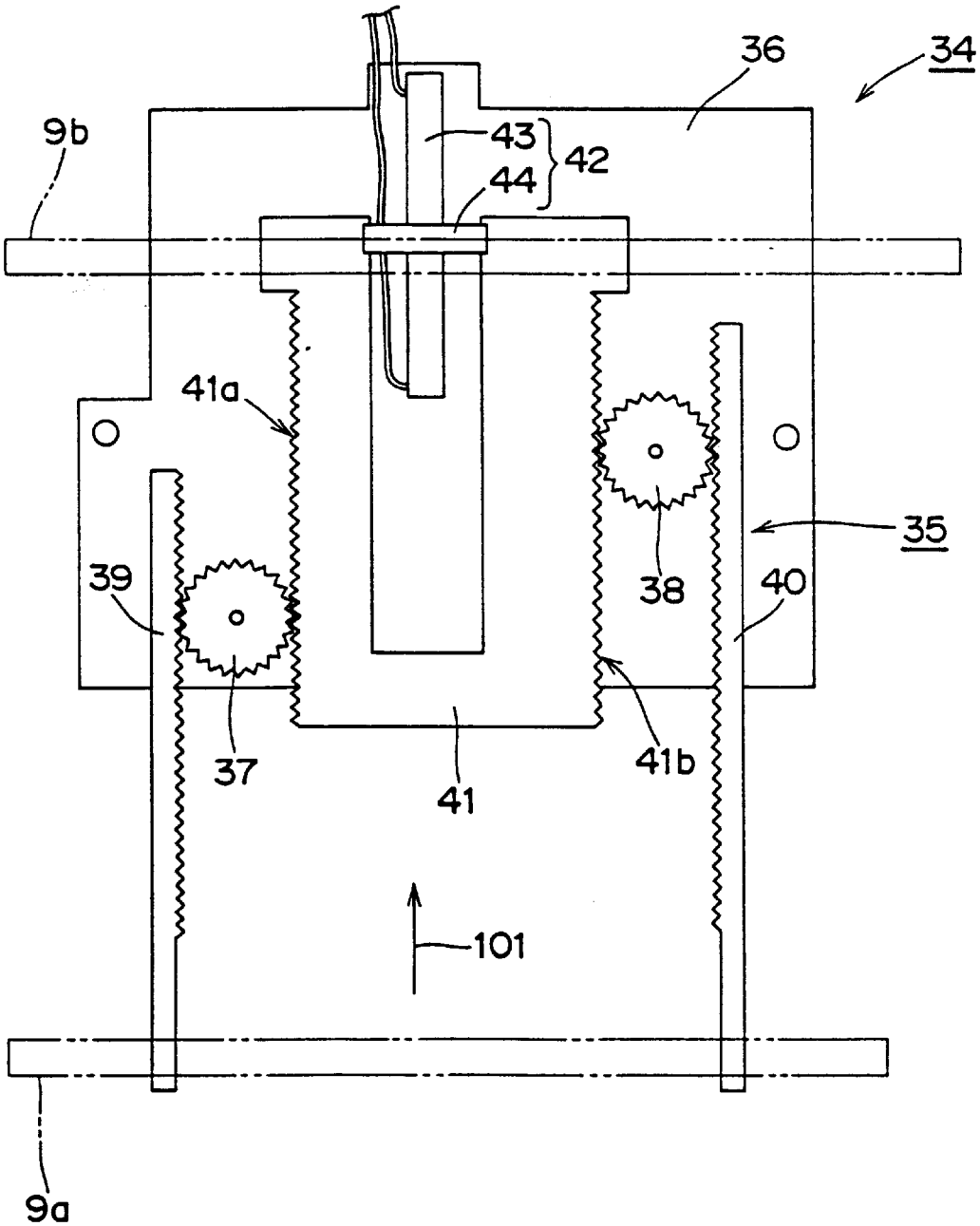
FIG. 3 is a plan view of a document width sensing mechanism for sensing the width of a document original set in place.

FIG. 3 is a plan view of the document width sensing mechanism for sensing the width of the document originals set in place.

The document width sensing mechanism 34 is provided below the document placing plate 8, and adapted to determine the size (width) of the document originals by sensing the amount of movement of the document width regulating guides 9*a* and 9*b*. The document width sensing mechanism 34 includes a width guide interlocking mechanism 35 for interlocking the document width regulating guides 9*a* and 9*b*, and a document width sensor 42 adapted to output a voltage in accordance with the amount of the movement of the document width regulating guide 9*b*.

The width guide interlocking mechanism 35 includes a base 36 fixed to the document placing plate 8, first and second pinions 37 and 38 provided on the base 36 and spaced a predetermined distance in a direction perpendicular to the direction of an arrow 101, a rack 39 geared with the first pinion 37, a rack 40 geared with the second pinion 38, and an interlocking plate 41 disposed between the racks 39 and 40.

The document width regulating guide 9*a* is attached to end portions of the racks 39 and 40 on one side thereof as spanning across the racks 39 and 40. The racks 39 and 40 slide on the upper surface of the base 36 in association with the sliding of the document width regulating guide 9*a*. The document width regulating guide 9*b* is attached to one end of the interlocking plate 41, which slides on the upper surface of the base 36 in association with the sliding of the document width regulating guide 9*b*.

Opposite edges of the interlocking plate 41 relative to the direction perpendicular to the direction of the arrow 101 are respectively formed with gearing surfaces 41*a* and 41*b*, which are geared with the first and second pinions 37 and 38, respectively. More specifically, the rack 39 and the gearing surface 41*a* of the interlocking plate 41 are opposed to each other to be geared with the first pinion 37. The rack 40 and the gearing surface 41*b* of the interlocking plate 41 are opposed to each other to be geared with the second pinion 38.

With this construction, when the document width regulating guide 9*a* is slid toward the document width regulating guide 9*b*, for example, the racks 39 and 40 slide in the direction of the arrow 101 in association with the sliding of the document width regulating guide 9*a*. Thus, the first pinion 37 is rotated clockwise as seen in FIG. 3, while the second pinion 38 is rotated counterclockwise as seen in FIG. 3. Since the interlocking plate 41 is slid in a direction opposite to the direction of the arrow 101 by the rotation of the first and second pinions 37 and 38, the document width regulating guide 9*b* is moved toward the document width regulating guide 9*a*.

Conversely, when the document width regulating guide 9*b* is slid away from the document width regulating guide 9*a*, for example, the interlocking plate 41 slides in the direction of the arrow 101 in association with the sliding of the document width regulating guide 9*b*. Thus, the first pinion 37 is rotated counterclockwise as seen in FIG. 3, while the second pinion 38 is rotated clockwise as seen in FIG. 3. Since the racks 39 and 40 are slid in a direction opposite to the direction of the arrow 101 by the rotation of the first and second pinions 37 and 38, the document width regulating guide 9*a* is moved away from the document width regulating guide 9*b*.

Thus, when either one of the document width regulating guides 9*a* and 9*b* is slid toward or away from the other, the other document width regulating guide slides toward or away from the one document width regulating guide in association with the sliding of the one document width regulating guide. Therefore, the widthwise center lines (center lines relative to the direction perpendicular to the document transportation direction) of the document originals set on the document placing plate 8 are aligned regardless of the document size.

The document width sensor 42 includes a resistor 43 attached to a predetermined position on the base 36 and a contactor 44 to be slid on the resistor 43 in contact therewith. A predetermined voltage is constantly applied to the resistor 43, and the document width sensor 42 outputs a voltage which varies depending on the position of the contactor 44.

Therefore, as the document width regulating guide 9*b* is slid in accordance with the size of the document originals set on the document placing plate 8, the resistor 43 slides so that the document width sensor 42 outputs a voltage corresponding to the document size. Thus, the width of the document originals set on the document placing plate 8 can be sensed on the basis of the output voltage.

Instead of the aforesaid variable resistance sensor, a variable capacity sensor may be used as the document width sensor 42, in which the capacity varies depending on the position of the document width regulating guide 9*b*. Alternatively, a plurality of photosensors may be employed as the document width sensor 42, which are adapted to sense the position of the document width regulating guide 9*b* on the basis of the outputs therefrom.

However, the amount of the sliding of the document width regulating guide 9*b* is the same where B5 size document originals are set in place with their length being perpendicular to the document transportation direction (so-called B5 longitudinal setting) and where B4 (JIS Column B No. 4) size document originals are set in place. Further, the amount of the sliding of the document width regulating guide 9*b* is the same where A4 (JIS column A No. 4) size document originals are set in place with their length being perpendicular to the document transportation direction (so-called A4 longitudinal setting) and where A3 size document originals are set in place. Without any special consideration, it would be impossible to make a distinction between the B5 longitudinal setting and the B4 setting and between the A4 longitudinal setting and the A3 setting.

In view of this, two document length sensors 45 and 46, for example, comprised of reflective sensors are provide on the document placing plate 8 as shown in FIGS. 1 and 2. The document length sensor 45 is provided in such a position that it is turned on in the case of the B4 setting but not turned on in the case of the B5 longitudinal setting. The document length sensor 46 is provided in such a position that it is turned on in the case of the A3 setting but not turned on in the case of the A4 longitudinal setting.

Thus, all the sizes of document originals possibly set on the document placing plate 8 can be distinguished on the basis of the outputs of the document width sensor 42 and the document length sensors 45 and 46. That is, the document width sensor 42 and the document length sensors 45 and 46 constitute the document size sensing mechanism.

Where document sizes other than those specified by the Japanese Industrial standards (JIS), such as US document sizes and EP document sizes are to be sensed by the document size sensing mechanism, a greater number of document length sensors may be employed.

Figure 4:
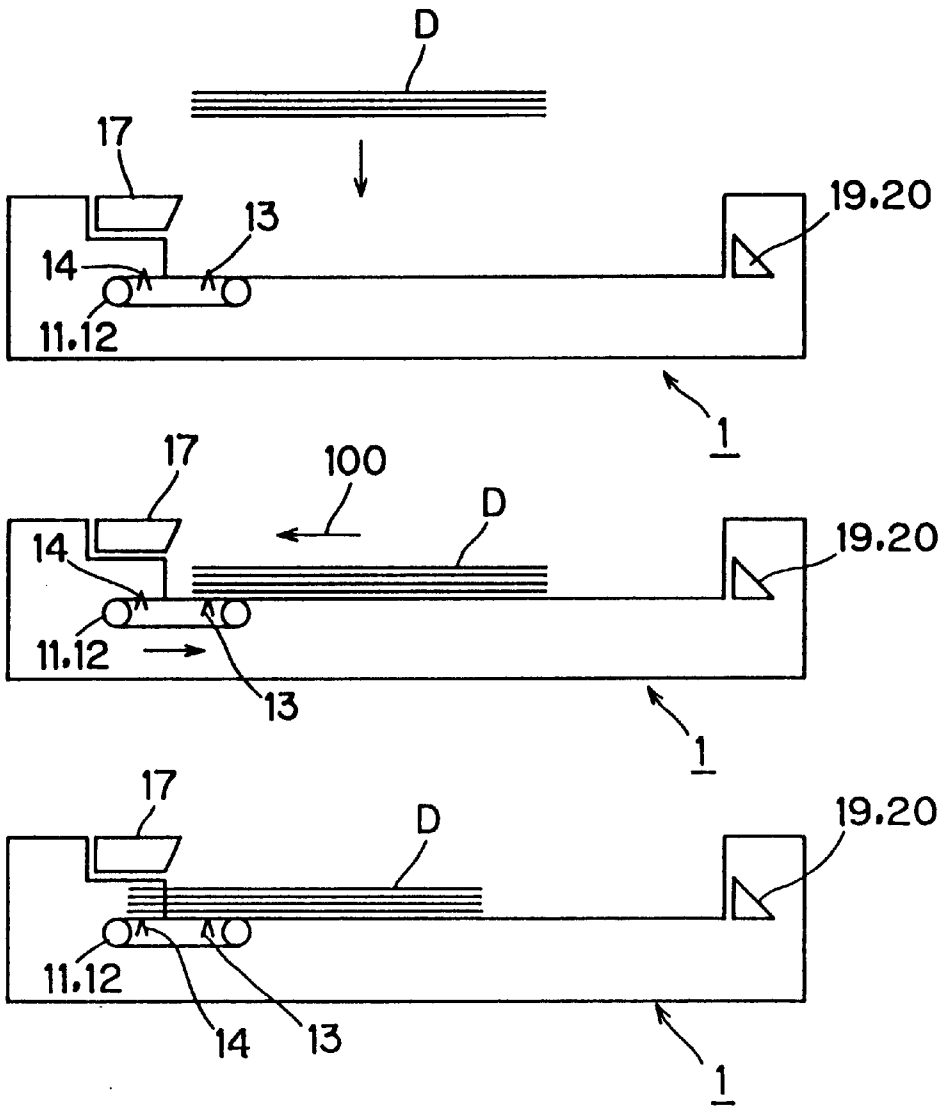
FIGS. 4(*a*) to 4(*c*) are schematic diagrams illustrating an operation of the recycle document feeder, particularly, to be performed when document orignals are set in place.

FIGS. 4(*a*) to 4(*c*) and 5(*a*) to 5(*g*) are schematic diagrams illustrating operations of the recycle document feeder 1. FIGS. 4(*a*) to 4(*c*) illustrate an operation to be performed when the document originals are set, while FIGS. 5(*a*) to 5(*g*) illustrate an operation to be performed when the document originals are transported.

The document setting operation will be described with reference to FIGS. 4(*a*) to 4(*c*).

When no document original is placed on the document placing plate 8, the preset switch 13 and the set switch 14 are off and the feed belts 11 and 12 are not driven as shown in FIG. 4(*a*).

When a user places a stack of document originals D on the document placing plate 8 after adjusting the document width regulating guides 9*a* and 9*b* in conformity with the size of the document originals, the preset switch 13 is pressed by the weight of the document originals D thereby to be turned on. Thus, the feed belts 11 and 12 start rotating counterclockwise as seen in FIG. 4(*b*), thereby transporting the stack of document originals D on the document placing plate 8 in the direction of the arrow 100 (see FIG. 4(*b*)).

When the stack of document originals D is transported in the direction of the arrow 100 so that the leading edge of the document stack reaches the set switch 14, the set switch 14 is pressed by the document originals D. After a lapse of the predetermined time period from the turn-on of the set switch 14, the feeding of the feed belts 11 and 12 is stopped, whereby the stack of document originals D is set in the predetermined setting position in a state as shown in FIG. 4(*c*). The size of the document originals thus set is determined on the basis of outputs of the document width sensor 42 and the two document length sensors 45 and 46 in this state.

Figures 5A, 5B, 5C, 5D, 5E, 5F, 5G:
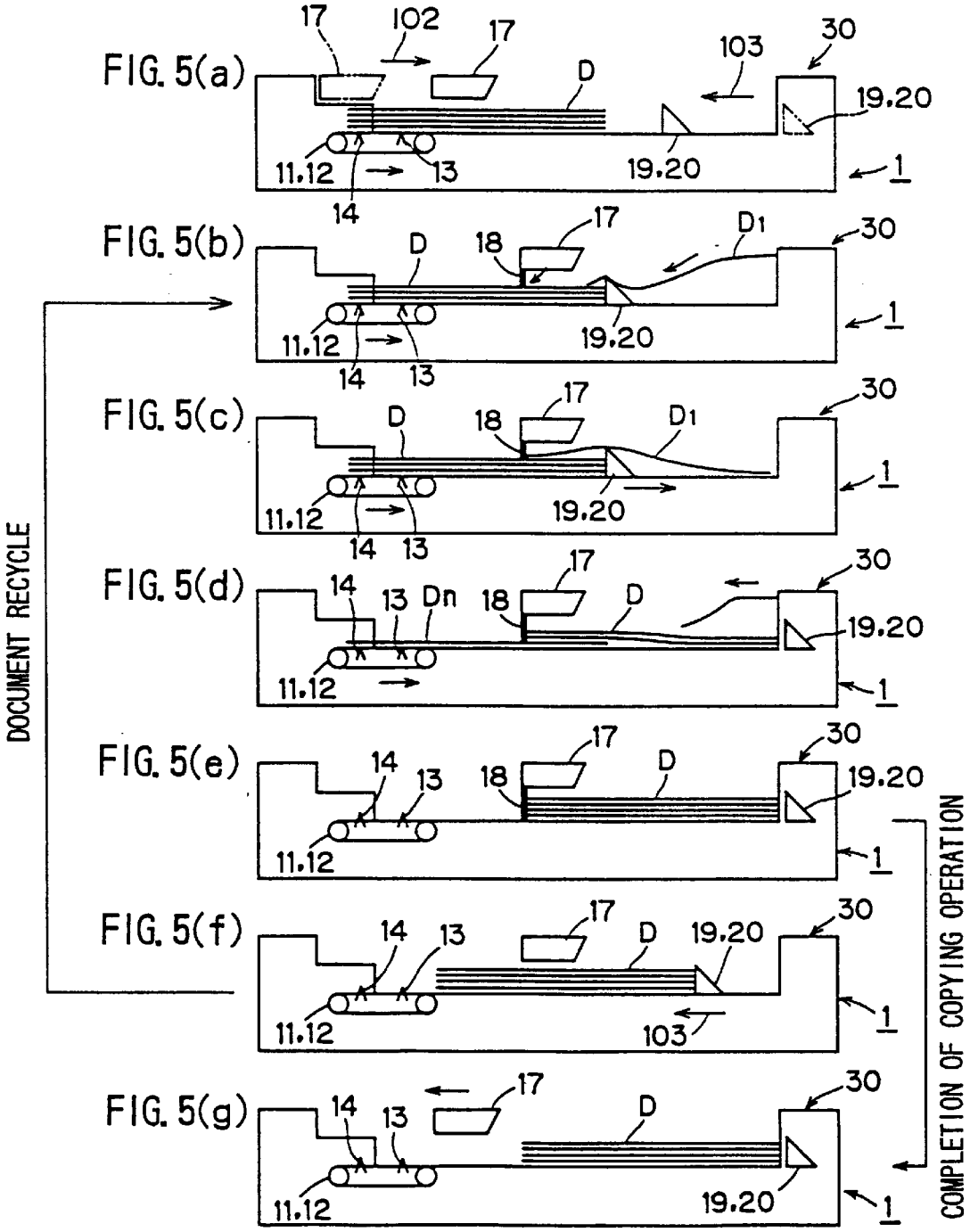
FIGS. 5(*a*) to 5(*g*) are schematic diagrams illustrating an operation of the recycle document feeder, particularly, to be performed when the document originals are transported.

Referring to FIGS. 5(*a*) to 5(*g*), an explanation will next be given to the document transporting operation, mainly to the operations of the partitioning unit 17 and the action plates 19 and 20.

When the print key 4 on the copying machine body 2 (see FIG. 2) is pressed after the document originals are set as shown in FIG. 4(*c*), the partitioning unit 17 is moved in the direction of an arrow 102 (in the direction opposite to the document transportation direction) from its home position indicated by a two-dot-and-dash line as shown in FIG. 5(*a*). The action plates 19 and 20 are moved in the direction of an arrow 103 (in the document transportation direction) from their home positions indicated by a two-dot-and-dash line. The amounts of the movement of the partitioning unit 17 and the action plates 19 and 20 are determined by the size of the document originals D set in place. More specifically, the partitioning unit 17 is moved to such a position that a distance between the partitioning bar 18 and the downstream edge of the document discharge portion 30 is equal to the document length (the length of the document originals D as measured in the document transportation direction) when the partition bar 18 of the partitioning unit 17 is lowered. The action plates 19 and 20 are moved to such a position that the downstream edges of the action plates 19 and 20 are brought in contact with the trailing edge of the stack of document originals D set in the setting position.

Simultaneously with the movement of the partitioning unit 17 and the action plates 19 and 20, the driving of the feed belts 11 and 12, the separator roller 21 and the separator belt 22 is started to feed the lowermost document $D_1$ out of the document placing plate 8. Upon completion of the movement of the partitioning unit 17 and the action plates 19 and 20, the partitioning bar 18 of the partitioning unit 17 is lowered so that a tip of the partitioning bar 18 abuts against the top surface of the stack of document originals D set in the setting position.

Referring to FIG. 5(*b*), the first document original (the lowermost document original at the document setting) $D_1$ fed back onto the document placing plate 8 after being subjected to the image reading operation for copying thereof is guided by the action plates 19 and 20 which have been moved forward, and the leading edge thereof is rested on the stack of document originals set in the setting position. Therefore, the document original $D_1$ fed back onto the document placing plate 8 is prevented from bumping against the stack of document original D set in the setting position, so that the document originals $D_1$ is not folded nor inserted between the document originals D. Since the leading edge of the document original $D_1$ thus fed back is stopped by the partitioning bar 18, the document original $D_1$ is not pushed downstream in the document transportation direction by an impetus added thereto when it is discharged from the document discharge portion. Thus, the document original $D_1$ thus fed back is divided from the document originals yet to be fed, thereby preventing needless document re-feeding.

When the first document original $D_1$ is fed back onto the document placing plate 18 as shown in FIG. 5(*c*), the action plates 19 and 20 are retracted to their home positions. Even with the action plates 19 and 20 retracted to their home positions, the second and subsequent document originals are properly guided on the first document original $D_1$ and, therefore, are not inserted between the document originals D set in the setting position. Since the partitioning bar 18 is kept lowered, the leading edges of the document originals fed back onto the document placing plate 8 are stopped by the partitioning bar 18 to be neatly aligned.

Thereafter, the feeding of the document originals is continued with the action plates 19 and 20 located in their home positions (see FIG. 5(*d*)). When the last one $D_n$ of the document originals D previously set in the setting position (the uppermost document original at the document setting) is fed out of the document placing plate 8, the set switch 14 is turned off. On the basis of the turn-off of the set switch 14, it is sensed that there is no document original on the document placing plate 8 yet to be fed.

Upon completion of the image reading of the document originals D previously set in the setting position, the recycle document feeder assumes a state as shown in FIG. 5(*e*). At this time, one copy of the document originals D is completed.

Where a plurality of copies are to be made, the partitioning bar 18 is retracted within the partitioning unit 17 so as to be shifted from the state shown in FIG. 5(*e*) to the inactive state, and then the action plates 19 and 20 are moved from their home positions in the direction of an arrow 103. Thus, the trailing edge of the stack of document originals D is pushed by the action plates 19 and 20 so that the document stack is moved toward the setting position. That is, the action plates 19 and 20 also function to transport the stack of document originals D for re-feeding of the document originals D.

When the stack of document originals D reaches the preset switch 13 to turn on the present switch 13, the driving of the feed belts 11 and 12 is started. The speed at which the action plates 19 and 20 are moved is set lower than the driving speed of the feed belts 11 and 12. Upon the start of the driving of the feed belts 11 and 12, the stack of document originals D is transported by the feed belts 11 and 12. When the stack of document originals D reaches the set switch 14, the set switch 14 is turned on. After a lapse of the predetermined time period from the turn-on of the set switch 14, the driving of the feed belts 11 and 12 is stopped. Thus, the stack of document originals D is set again in the setting position. Thereafter, the action plates 19 and 20 are stopped in such a position that they abut against the trailing edge of the stack of document originals D, and the partitioning bar 18 is lowered. Then, the second document feeding operation cycle is performed (see FIG. 5(*b*)).

When the recycle document feeder assumes the state shown in FIG. 5(*e*) after a required number of copies are made, the partitioning bar 18 is retracted within the partitioning unit 17. Then, the partitioning unit 17 is returned to its home position (see FIG. 5(*g*)). Therefore, the partitioning unit 17 does not hinder a user from removing the document originals D from the document placing plate 8.

Thus, the leading edges of the document originals D fed back onto the document placing plate 8 are aligned by the partitioning bar 18. Accordingly, the user can readily remove the document originals from the document placing plate 8 after the completion of the document feeding operation.

The partitioning unit 17 is not returned to its home position until the completion of the document feeding operation, and the partitioning bar 18 is kept in the active state during the document feeding operation cycle. Therefore, an operation noise which may be made in the case of the prior art recycle document feeder does not grate upon user's ears. In the case of the prior art recycle document feeder, the document discharge portion includes two mechanisms required for aligning the document originals D fed back onto the document placing plate 8, i.e., a document press-down mechanism and a document drawing mechanism. In the recycle document feeder 1 according to the invention, however, the single partitioning bar 18 serves to align the document originals so that the document discharge portion 30 has a reduced size. Further, the costs of the document feeder can be reduced in comparison with the prior art construction which includes the aforesaid two mechanisms.

Figure 6:
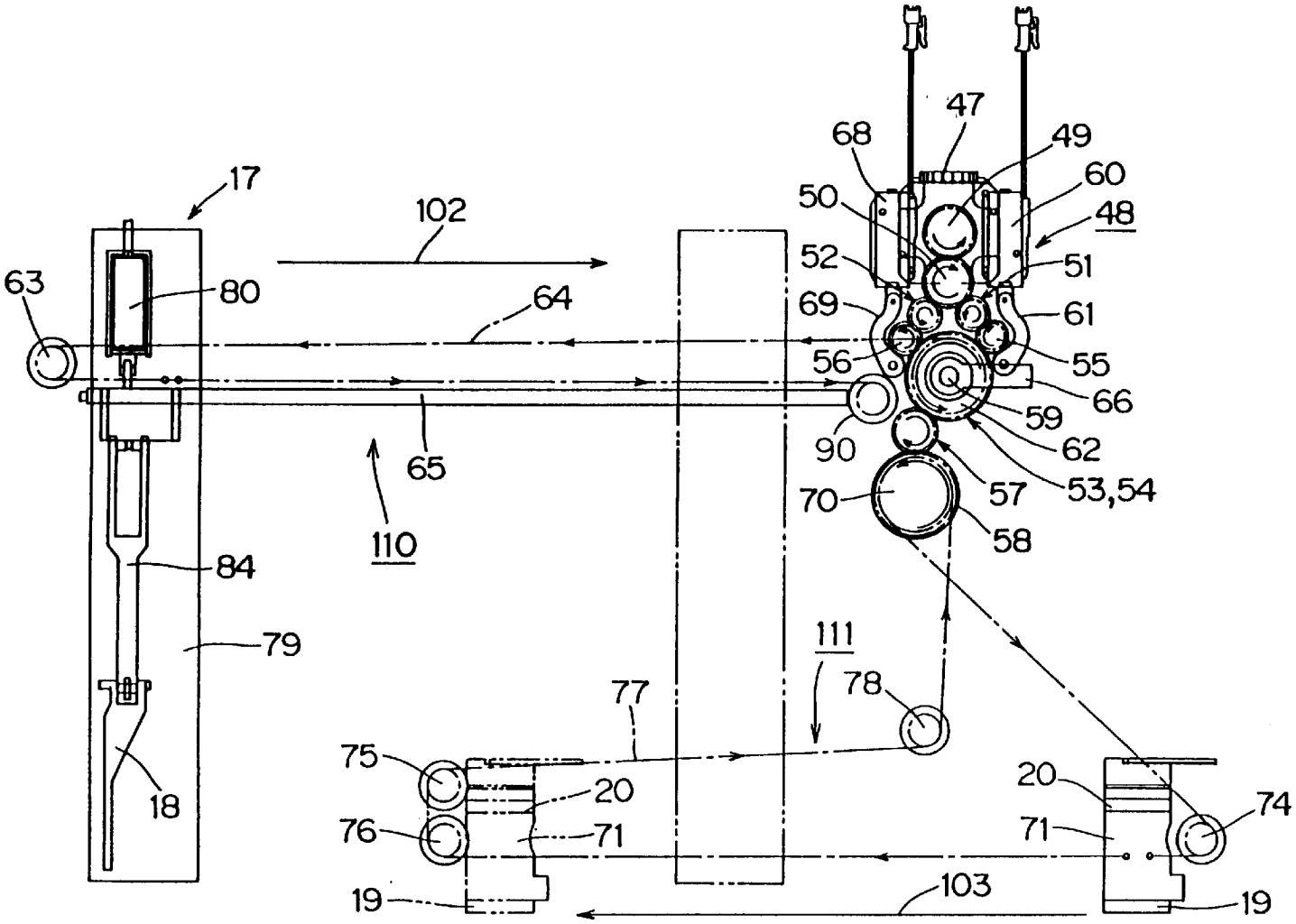
FIG. 6 is a plan view illustrating the construction of a driving mechanism for reciprocally moving a partitioning unit and action plates.

FIG. 6 is a plan view illustrating the construction of a driving mechanism for reciprocally moving the partitioning unit 17 and the action plates 19 and 20.

The driving mechanism includes a motor 47 rotatable in regular and reverse directions and a gear mechanism 48 having ten gears 49 to 58, which are provided in the innermost of the document discharge portion 30 as seen in FIG. 1. The driving mechanism further includes a unit driving mechanism 110 which receives a driving force of the motor 47 transmitted through the gear mechanism 48 and an action plate driving mechanism 111. The unit driving mechanism 110 and the action plate driving mechanism 111 are disposed below the document placing plate 8.

More specifically, the motor 47 is comprised of a stepping motor, for example, for moving the partitioning unit 17 and the action plates 19 and 20 at a high accuracy. A first gear 49 is attached to an output shaft of the motor 47. A second gear 50 gears with the first gear 49 so that the rotation of the motor 47 is transmitted to the second gear 50. Third and fourth gears 51 and 52 gear with the second gear 50 so that the rotation of the second gear 50 is transmitted to both the third and fourth gears 51 and 52.

Fifth and sixth gears 53 and 54 are spaced a predetermined distance apart from the third and fourth gears 51 and 52, respectively. The fifth and sixth gears 53 and 54 are attached to a common center shaft 59 and adapted to rotate independently.

A seventh gear 55 is disposed between the third and fifth gears 51 and 53. The seventh gear 55 can be shifted between a state where it gears with both the third and fifth gears 51 and 53 and a state where it gears only with the fifth gear 53, depending on the on/off of a unit moving solenoid 60.

Figure 7:
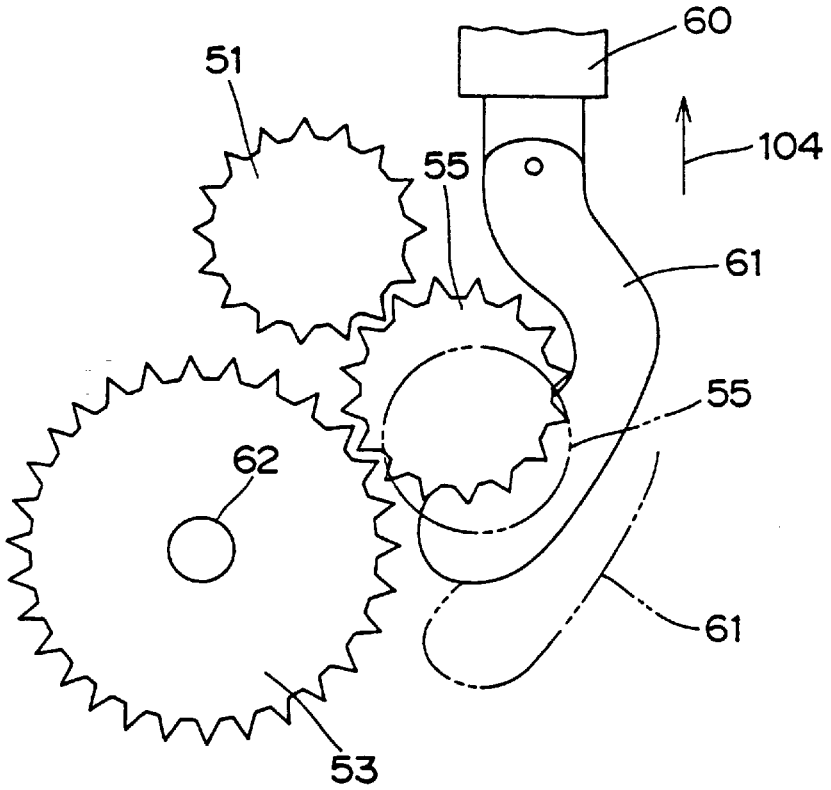
FIG. 7 is a schematic diagram for explaining a mechanism for permitting and interrupting transmission of a driving force of a motor.

More specifically, referring to FIG. 7, the unit moving solenoid 60 is connected to a drawing arm 61 having a chevron shape in plan. The unit moving solenoid 60 and the drawing arm 61 constitute unit driving force switching means.

When the unit moving solenoid 60 is turned on, the drawing arm 61 is moved in the direction of an arrow 104.

The seventh gear 55 is shifted from a position as indicated by a two-dot-and-dash line to a position as indicated by a solid line by the drawing arm 61, so that the seventh gear 55 gears with the third gear 51. Thus, the rotation force of the motor 47 transmitted through the first and second gears 49 and 50 to the third gear 51 is further transmitted to the fifth gear 53 through the seventh gear 55.

The drawing arm 61 is biased in a direction opposite to the direction of the arrow 104 by a coil spring not shown. Therefore, when the unit moving solenoid 60 is turned off, the drawing arm 61 is shifted back to the position indicated by the two-dot-and-dash line by the biasing force of the coil spring. Thus, the seventh gear 55 is disengaged from the third gear 51, so that the rotation force of the motor 47 is not transmitted to the fifth gear 53.

In some cases, the seventh gear 55 is not disengaged from the third gear 51 even if the unit moving solenoid 60 is turned off to shift the drawing arm 61 back to the position indicated by the two-dot-and-dash line. This is because the seventh gear 55 gears with both the third and fifth gears 51 and 53. In this embodiment, after the unit moving solenoid 60 is turned off, the motor 47 is slightly rotated in a direction opposite to the direction in which the motor 47 is rotated immediately before the turn-off of the unit moving solenoid 60 (back-lash adjustment). The slight rotation of the motor 47 is such that the third gear 51 is rotated at an angle equivalent to a back-lash between the third and seventh gears 51 and 55. Thus, the seventh gear 55 is assuredly disengaged from the third gear 51.

Referring again to FIG. 6, the unit driving mechanism 110 includes a large wire pulley 62 integral with the fifth gear 53, a small wire pulley 63 spaced a predetermined distance apart from the large wire pulley 62 in the document transportation direction (leftward as seen in FIG. 6), i.e., provided adjacent to the home position of the partitioning unit 17, and a wire 64 stretched around the large wire pulley 62 and the small wire pulley 63 with its opposite ends fixed to the partitioning unit 17. The large wire pulley 62 integral with the fifth gear 53 is rotated by the rotation of the motor 47 transmitted to the fifth gear 53 upon the turn-on of the unit moving solenoid 60. The wire 64 is moved in association with the rotation of the large wire pulley 62, so that the partitioning unit 17 travels along a slide shaft 65 extending in the document transportation direction.

A pulley 90 provided adjacent to the large wire pulley 62 serves to apply a predetermined tension to the wire 64 and to keep the wire 64 parallel to the slide shaft 65 (the direction of the movement of the partitioning unit 17).

When the motor 47 is rotated counterclockwise, for example, the rotation force of the motor 47 is transmitted to the fifth gear 53 through the first, second, third and seventh gears 50, 51 and 55 to rotate the fifth gear 53 counterclockwise. The large wire pulley 62 is also rotated counterclockwise by the rotation of the fifth gear 53, so that the wire 64 travels counterclockwise. Thus, the partitioning unit 17 is moved from its home position indicated by a solid line in FIG. 6 in the direction of an arrow 102.

When the partitioning unit 17 reaches a predetermined position (e.g., a position as indicated by a two-dot-and-dash line in FIG. 6), the unit moving solenoid 60 is turned off so that the seventh gear 55 is disengaged from the third gear 51. Thus, the rotation force of the motor 47 is no longer transmitted to the seventh gear 55, thereby stopping the partitioning unit 17.

When the partitioning unit 17 is at a standstill, the seventh gear 55 is kept in disengagement from the third gear 51. Therefore, the partitioning unit 17 would be reciprocally movable along the slide shaft 65 without any special consideration. This means that, if a user touches the partitioning unit 17 during the document transportation operation, the partitioning unit 17 would be displaced so that document originals fed back onto the document placing plate 8 (see FIG. 1) could randomly be arranged. In this embodiment, the driving mechanism has a hold mechanism for holding the partitioning unit 17 to prevent the partitioning unit 17 from being easily moved when the partitioning unit 17 is at a standstill.

Figure 8:
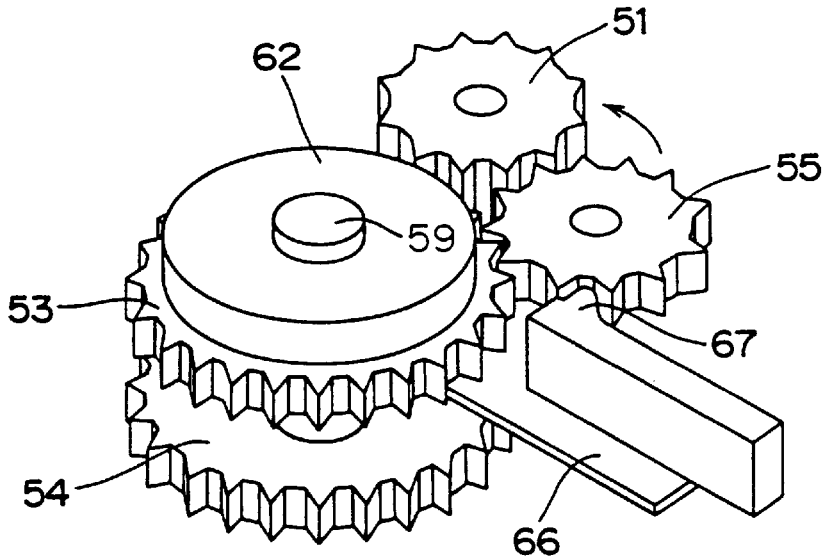
FIG. 8 is a perspective view illustrating the construction of a hold mechanism provided in the driving mechanism.

FIG. 8 is a perspective view illustrating the construction of the hold mechanism provided in the driving mechanism.

The hold mechanism includes a plate member 66 attached to the center shaft 59 of the fifth and sixth gears 53 and 54 and an engagement claw 67 fixed on the top face of the plate member 66. The engagement claw 67 is located in such a position that, when the seventh gear 55 gears with the third gear 51, the engagement claw 67 is kept apart from the seventh gear 55 and, when the seventh gear 55 is disengaged from the third gear 51, a tip of the engagement claw 67 is fitted in a tooth space of the seventh gear 55. That is, when the seventh gear 55 is disengaged from the third gear 51, the engagement claw 67 is engaged with the seventh gear 55 to prevent the seventh gear 55 from rotating. Thus, the partitioning unit 17 cannot readily be moved manually.

After the completion of the document feeding operation, a user who does not know that the partitioning unit 17 is automatically returned to its home position would forcibly return the partitioning unit 17 to the home position. This could result in breakage of the gear mechanism 48 if the engagement claw 67 was adapted to absolutely prevent the partitioning unit 17 from being manually moved. Particularly, this could result in breakage of the engagement claw 67 and the fifth and seventh gears 53 and 55.

To prevent such an inconvenience, the engagement claw 67 is adapted to be disengaged from the seventh gear 55 to permit the movement of the partitioning unit 17 if a force greater than a certain level is applied to the partitioning unit 17. The level of the force for triggering the disengagement of the engagement claw 67 from the seventh gear 55 depends on the size and shape of the engagement claw 67.

Referring to FIG. 6, an eighth gear 56 is disposed between the fourth gear 52 and the sixth gear 54. The eighth gear 56 can be shifted between a state where it gears with both the fourth and sixth gears 52 and 54 and a state where it gears only with the sixth gear 54, depending on the on/off of an action plate moving solenoid 68. Since the arrangement for shifting the eighth gear 56 is the same as the arrangement for shifting the seventh gear 55, a detailed description will not be given thereto.

A drawing arm 69 is connected to the action plate moving solenoid 68. The action plate moving solenoid 68 and the drawing arm 69 constitute the action plate driving force switching means. When the action plate moving solenoid 68 is turned on, the drawing arm 69 is drawn in, and the eighth gear 56 is shifted by the drawing arm 69 so as to gear with the fourth gear 52. Thus, the rotation force of the motor 47 transmitted to the fourth gear 52 through the first and second gears 49 and 50 is further transmitted to the sixth gear 54 through the eighth gear 56.

When the action plate moving solenoid 68 is turned off, the eighth gear 56 is disengaged from the fourth gear 52, so that the rotation force of the motor 47 is no longer transmitted to the eighth gear 56. After the action plate moving solenoid 68 is turned off, the motor 47 is slightly rotated in the reverse direction, whereby the eighth gear 56 is assuredly disengaged from the fourth gear 52 (back-lash adjustment).

The sixth gear 54 gears with a ninth gear 57. The ninth gear 57 further gears with a tenth gear 58. The tenth gear 58 is rotated by the rotation force of the motor 47 transmitted to the sixth gear 54. Then, the rotation force transmitted to the tenth gear 58 is applied to the action plate driving mechanism 111.

The action plate driving mechanism 111 includes a large wire pulley 70 and three small wire pulleys 74, 75 and 76, and a wire 77 stretched around the larger wire pulley 70 and the small wire pulleys 74, 75 and 76. More specifically, the large wire pulley 70 is integral with the tenth gear 58 so that the large wire pulley 70 is rotated with the rotation of the tenth gear 58.

The small pulley 74 is disposed adjacent to the home positions of the action plates 19 and 20 (as indicated by a solid line in FIG. 6). The other two small pulleys 75 and 76 are disposed adjacent to a position where the action plates 19 and 20 are shifted in the document transporting direction at the maximum (as indicated by a two-dot-and-dash line). The opposite ends of the wire 77 stretched around the large wire pulley 70 and the small wire pulleys 74, 75 and 76 are fixed to the coupling plate 71, so that the wire 77 travels in association with the rotation of the large wire pulley 70. Thus, the action plates 19 and 20 are moved along the guide rails 72 and 73.

A reference numeral 78 denotes a tension pulley disposed between the large wire pulley 70 and the small wire pulley 75 for applying a predetermined tension to the wire 77.

The wire 77 intersects itself between the large wire pulley 70 and the tension pulley 78. Therefore, the partitioning unit 17 and the action plates 19 and 20 are simultaneously moved toward or away from each other by simultaneously turning on the unit moving solenoid 60 and the action plate moving solenoid 68.

As described above, the driving force of the motor 47 is transmitted to the unit driving mechanism 110 and the action plate driving mechanism 111 through the gear mechanism 48 to reciprocally move the partitioning unit 17 and the action plates 19 and 20 in the document transportation direction. That is, the partitioning unit 17 and the action plates 19 and 20 are moved by the common motor 47. Therefore, the size of the driving mechanism can be reduced in comparison with a case where motors are independently provided. In addition, the employment of the single motor leads to a reduced cost.

Figure 9:
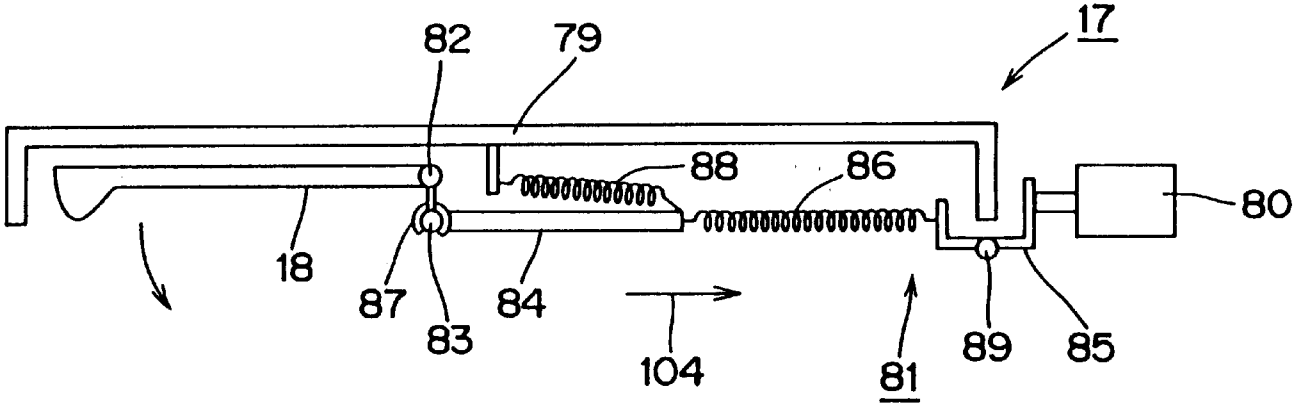
FIGS. 9(*a*) and 9(*b*) are schematic diagrams for explaining the construction of the partitioning unit and the operation of a partitioning bar.
Figure 9:
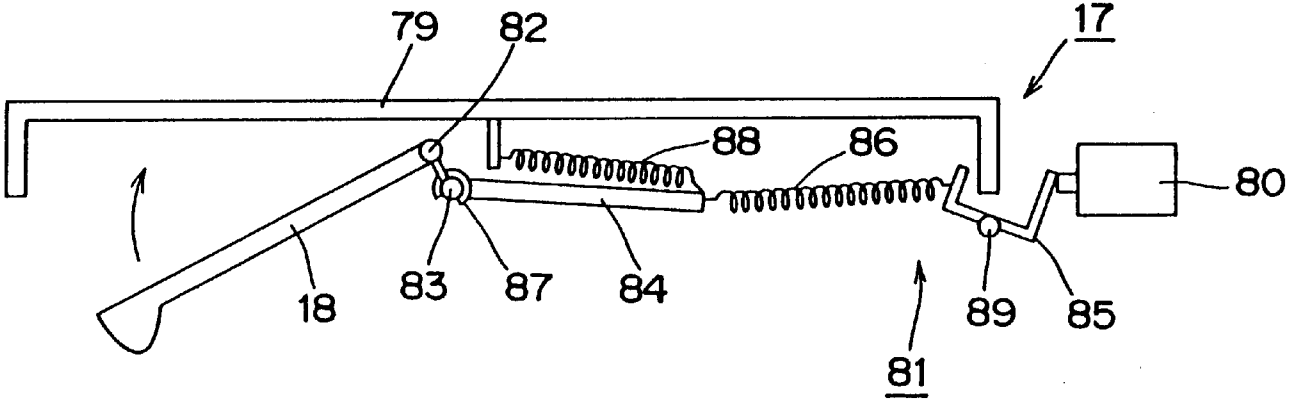

FIGS. 9(*a*) and 9(*b*) are schematic diagrams for explaining the construction of the partitioning unit 17 and the operation of the partitioning bar 18. Particularly, FIG. 9(*a*) illustrates the inactive state of the partitioning bar 18, whereas FIG. 9(*b*) illustrates the active state of the partitioning bar 18.

Referring to FIGS. 9(*a*) and 9(*b*), the partitioning unit 17 includes a unit cover 79 with its length perpendicular to a unit moving direction, the partitioning bar 18 rotatably supported by the unit cover 79, a bar driving solenoid 80 for shifting the partitioning bar 18 between the inactive state where it is retracted within the unit cover 79 and the active state where a distal end thereof abuts against the upper surface of the document stack set in place, and an interlocking mechanism 81 for interlocking the bar driving solenoid 80 and the partitioning bar 18.

The partitioning bar 18 has a support shaft 82 provided at its proximal end and extending perpendicularly to the length of the partitioning bar 18 (perpendicularly to the paper face of FIGS. 9(*a*) and 9(*b*)). The support shaft 82 is rotatably attached to the unit cover 79, and the partitioning bar 18 is supported pivotally about the support shaft 82 to be shifted between the inactive state shown in FIG. 9(*a*) and the active state shown in FIG. 9(*b*). A connection pin 83 extending parallel to the support shaft 82 is provided below the support shaft 82.

The interlocking mechanism 81 includes an interlocking lever 84 connected to the connection pin 83, a seesaw member 85 connected to the bar driving solenoid 80, and a connection coil spring 86 connecting the interlocking lever 84 and the seesaw member 85.

The interlocking lever 84 is an elongate member extending along the length of the unit cover 79 and has a grip member 87 at one end thereof. The grip member 87 is of a generally C shape in section and open to its lower side. The grip member 87 is loosely engaged with the connection pin 83 of the partitioning bar 18 so that the partitioning bar 18 is connected to the interlocking lever 84 for relative pivotal movement.

The other end of the interlocking lever 84 is connected to one end of a tension coil spring 88 which is connected to a predetermined position of the unit cover 79 at the other end thereof. The interlocking lever 84 is biased in a direction opposite to the direction of an arrow 104 by the resilient force of the tension coil spring 88. The other end of the interlocking lever 84 is further connected to the seesaw member 85 via the connection coil spring 86. The seesaw member 85 is supported pivotally about a shaft 89, and adapted to be pivoted in association with the on/off of the bar driving solenoid 80.

When the bar driving solenoid 80 is turned on with the partitioning bar assuming the inactive state shown in FIG. 9(*a*), one end of the seesaw member 85 is drawn in the direction of the arrow 104, whereby the seesaw member 85 is rotated clockwise about the shaft 89 to draw the connection coil spring 86 connected to the other end thereof in the direction of the arrow 104. The connection coil spring 86 has a greater resilient force than the tension coil spring 88 and, therefore, the interlocking lever 84 is displaced in the direction of the arrow 104 in opposition to the resilient force of the tension coil spring 88 when the connection coil spring 86 is drawn. Accordingly, the connection pin 83 of the partitioning bar 18 is drawn in the direction of the arrow 104 by the interlocking lever 84. Thus, the partitioning bar 18 is rotated counterclockwise about the support shaft 82 thereby to be shifted to the active state shown in FIG. 9(*b*).

The distal end of the partitioning bar 18 shifted into the active state abuts against the top surface of the document stack set on the document placing plate 8. If a large number of document originals are set on the document placing plate 8 at this time, the document originals prevent the partitioning bar 18 from being shifted to the active state, though the bar driving solenoid 80 operates to shift the partitioning bar 18 to the active state. As a result, a load is imposed on the interlocking mechanism 81. For this reason, the connection coil spring 86 is interposed between the interlocking lever 84 and the seesaw member 85 so as to absorb a load, which may be imposed on the interlocking mechanism 81 when a large number of document originals are set, by extension of the connection coil spring 86.

When the bar driving solenoid 80 is turned off with the partitioning bar 18 assuming the active state, the interlocking lever 84 is moved in the direction opposite to the direction of the arrow 104 by the resilient force of the coil spring 88. Therefore, the partitioning bar 18 is rotated clockwise about the support shaft 82 to be shifted back to the inactive state shown in FIG. 9(*a*).

Figure 10:
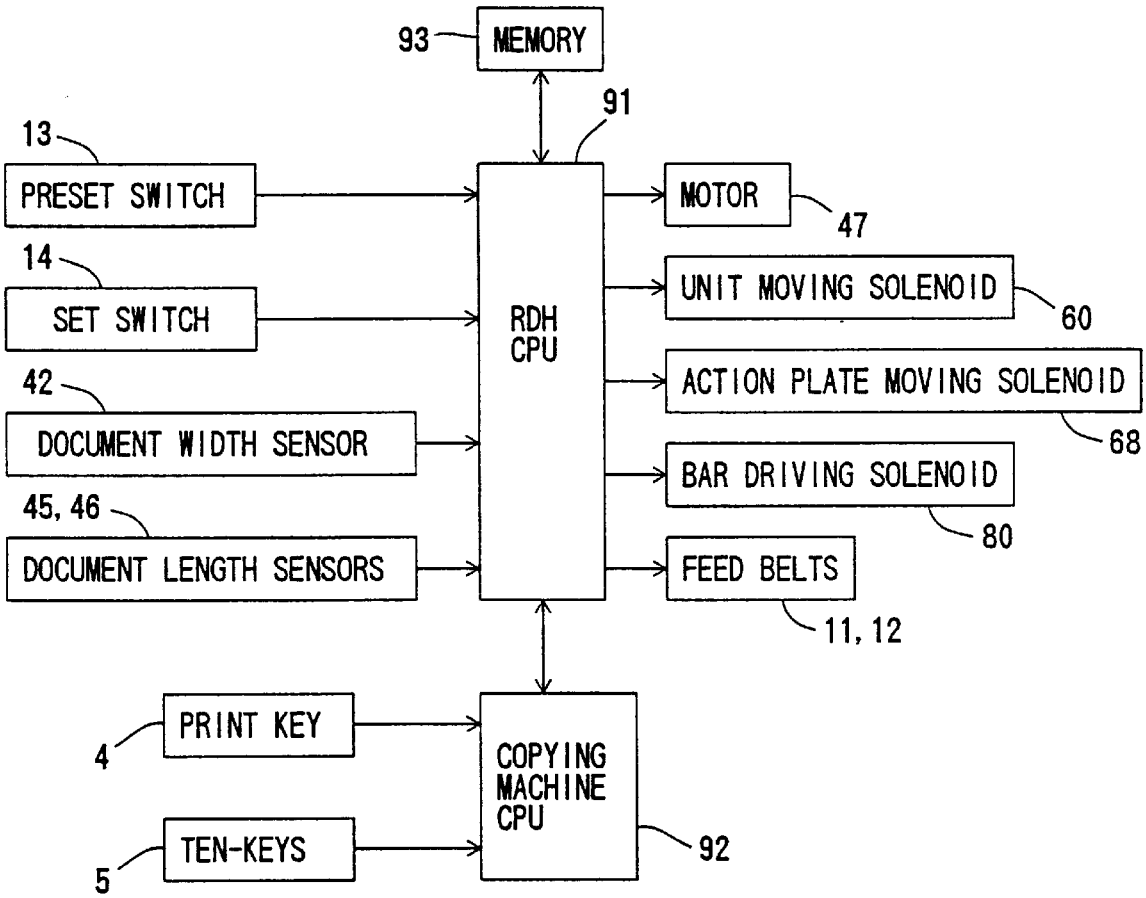
FIG. 10 is a block diagram illustrating the construction of a control circuit of the recycle document feeder according to the embodiment.

FIG. 10 is a block diagram illustrating the construction of a control circuit of the recycle document feeder 1 according to the embodiment and a relationship between the control circuit and a control section of the copying machine body 2.

The control circuit mainly controls the driving of the feed belts 11 and 12, the partitioning unit 17 and the action plates 19 and 20, and includes a CPU 91 for RDH (recycle document handler) as a control center. The RDH CPU 91 receives outputs from the preset switch 13, the set switch 14, the document width sensor 42 and the document length sensors 45 and 46.

The RDH CPU 91 is connected to a memory 93. The memory 93 stores therein data, such as the movement amounts of the partitioning unit 17 and the action plates 19 and 20 and the driving period of the feed belts 11 and 12 from the turn-on of the set switch 14, for the respective document sizes. The RDH CPU 91 controls the motor 47, the unit moving solenoid 60, the action plate moving solenoid 68, the bar driving solenoid 80 and the feed belts 11 and 12 on the basis of the data stored in the memory 93 and the outputs of the respective sensors.

The RDH CPU 91 is further connected to a copying machine CPU 92 provided in the copying machine body 2. The copying machine CPU 92 receives signals from the ten-keys 5 and the print key 4 for giving a copying operation start command. The ten-keys are used to input how many copies are to be made from one stack of document originals. In response to the signal from the print key 4, the copying machine CPU 92 starts controlling the copying operation in the copying machine body 2, and gives commands necessary to drive the recycle document feeder 1 to the RDH CPU 91. Further, control signals are applied from the RDH CPU 91 to the copying machine CPU 92 so as to be used for the copying operation control by the copying machine CPU 92.

Figure 11:
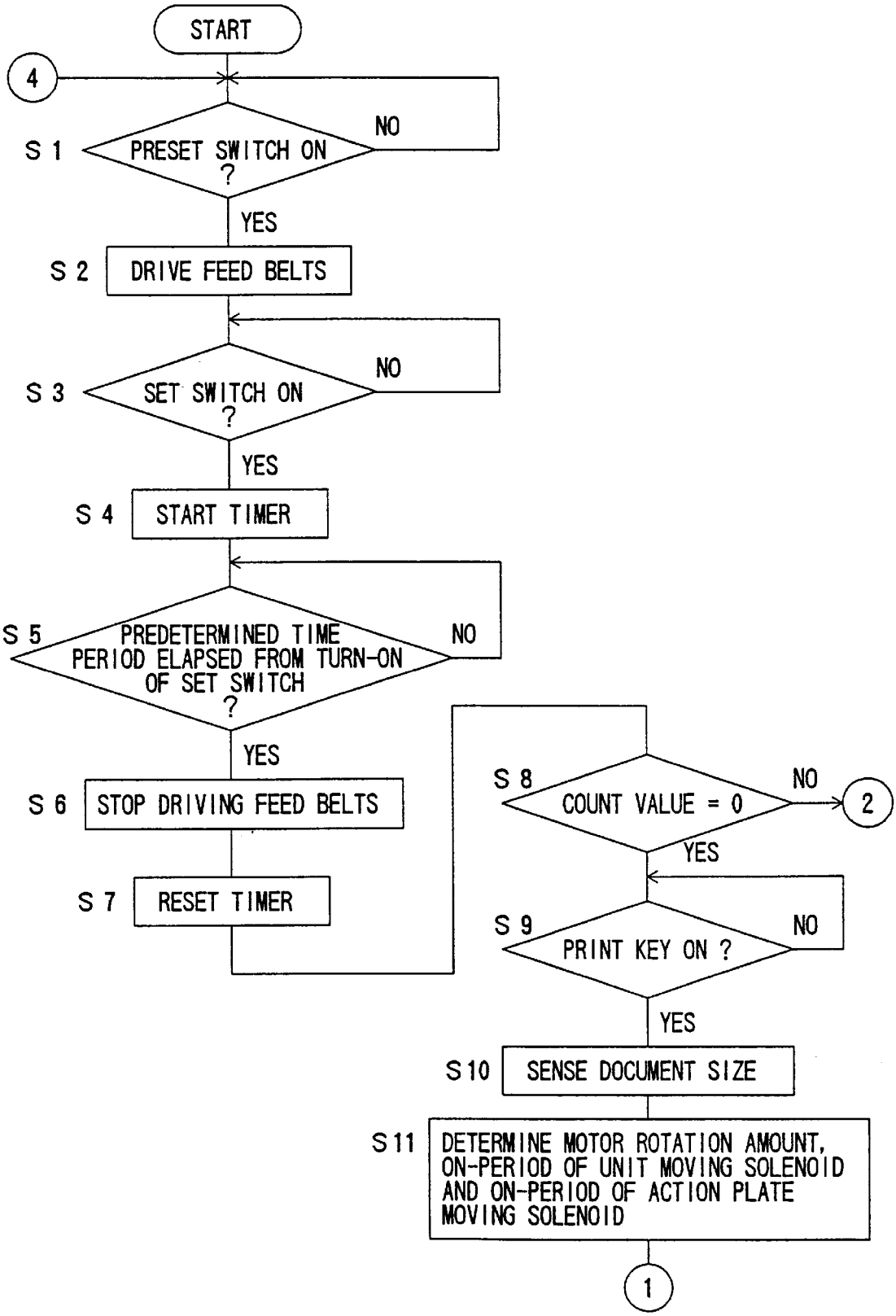
FIG. 11 is a flow chart illustrating the control operation of the recycle document feeder.
Figure 12:
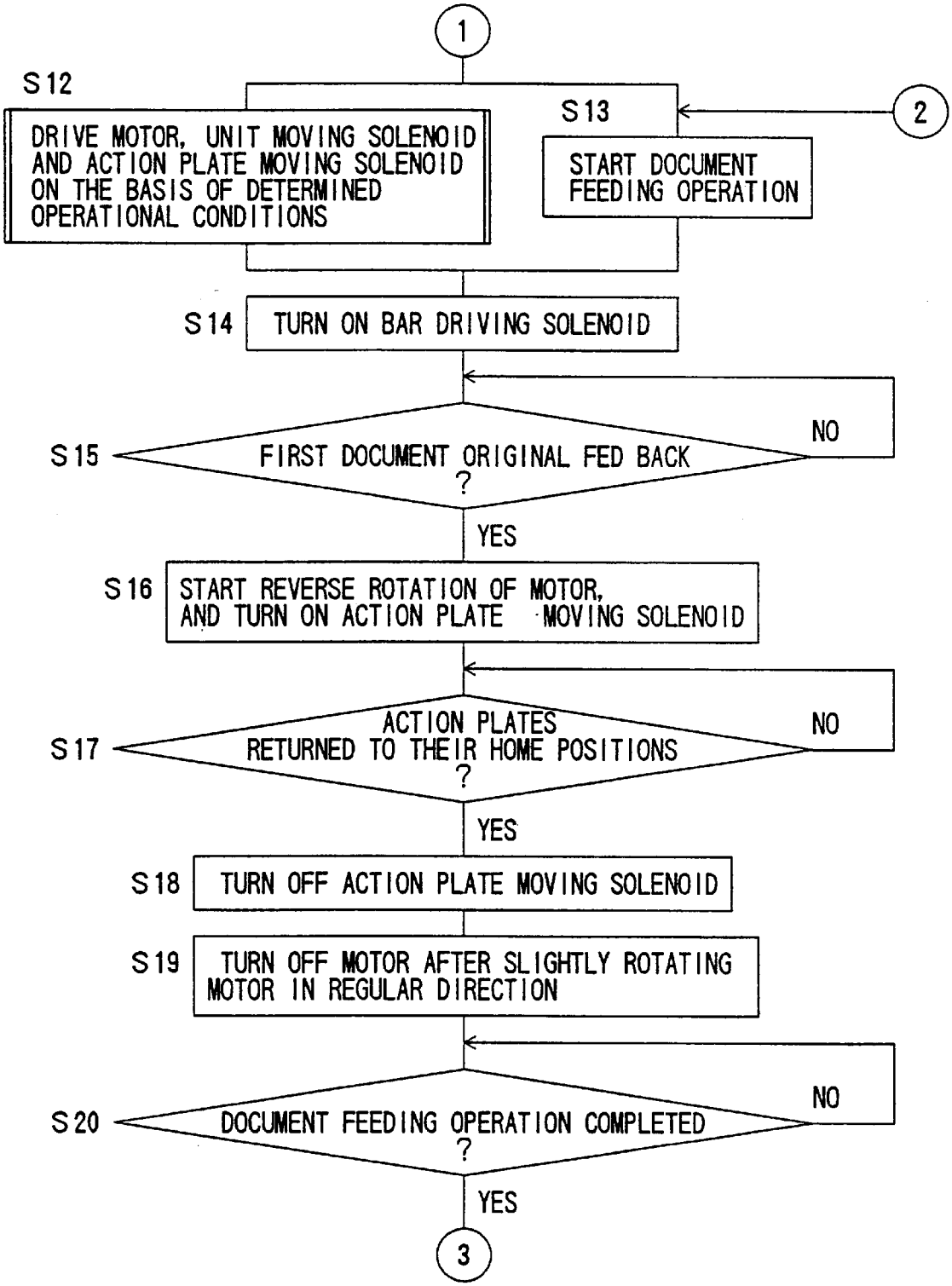
FIG. 12 is a flow chart illustrating the control operation of the recycle document feeder.
Figure 13:
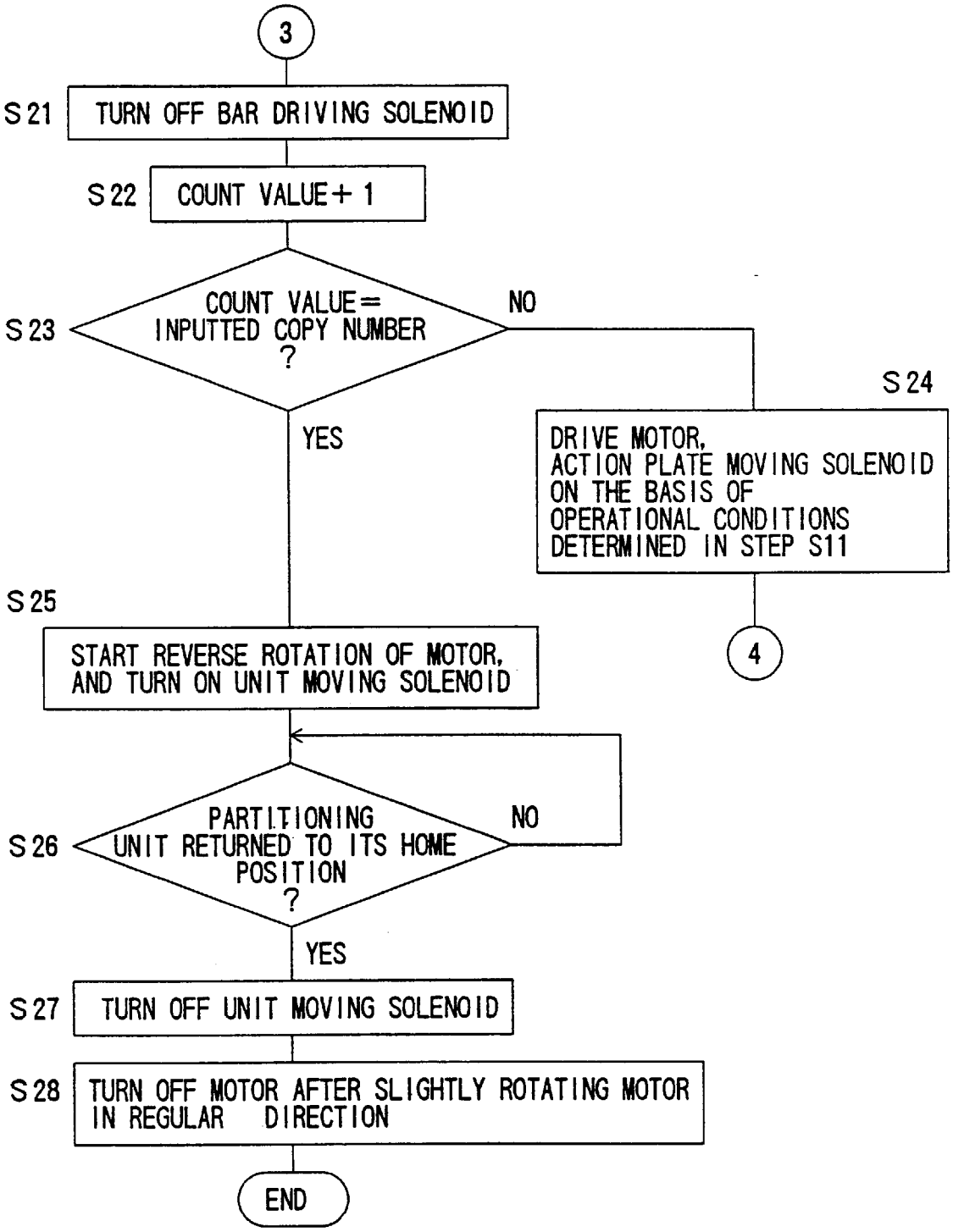
FIG. 13 is a flow chart illustrating the control operation of the recycle document feeder.

FIGS. 11 to 13 are flow charts for explaining the control operation of the recycle document feeder 1. With reference to FIGS. 4(*a*) to 4(*c*) and 5(*a*) to 5(*g*), the driving control of the feed belts 11 and 12, the partitioning unit 17 and the action plates 19 and 20 will hereinafter be explained in accordance with the flow charts shown in FIGS. 11 and 12.

A user slides the document width regulating guides 9*a* and 9*b* in conformity of the size of document originals to be set on the document placing plate 8, and then places the document originals D on the document placing plate 8. When the document originals D are placed on the document placing plate 8, the preset switch 13 is turned on (YES in Step S1) thereby to start the driving of the feed belts 11 and 12 (Step S2). Thus, the document originals D are transported in the direction of the arrow 100 as shown in FIG. 4(*b*).

When the set switch 13 is turned on by the document originals D thus transported (YES in Step S3), a timer not shown is started for measuring the ON period of the set switch 13 (Step S4). In Step S5, the time measurement by the timer is monitored and, when the lapse of the predetermined time period is determined by the timer, the branch condition in Step S5 is satisfied so that the driving of the feed belts 11 and 12 is stopped (Step S6). Then, the timer is reset (Step S7), and the setting of the document originals is completed (see FIG. 4(*c*)). Upon the completion of the document setting, the value of an inside counter in the RDH CPU 91 is checked, and it is judged whether or not the counter value is zero (Step S8). This counter value represents how many times the document originals are recycled for the document feeding operation by the recycle document feeder 1. Since the document originals are not transported yet at this time, the branch condition in Step S8 is satisfied, so that the process goes to Step S9.

The recycle document feeder 1 is kept on standby with the setting of the document originals completed until the user presses the print key 4 on the copying machine body 2. When the user presses the print key 4 after operating the ten-keys 5 to input how many copies of the document originals are to be made (YES in Step 9), the RDH CPU 91 determines the size of the document originals set in place with reference to the outputs of the document width sensor 42 and the document length sensors 45 and 46 (Step S10). Then, the RDH CPU 91 determines the rotation number (step number) of the motor 47 and the ON periods of the unit moving solenoid 60 and the action plate moving solenoid 68 on the basis of the determined document size and the data stored in the memory 93 (Step S11).

The determination of the size of the document originals set in the setting position may precede the pressing of the print key 4, i.e., the judgment in Step S9.

Upon the determination of the respective operational conditions in Step S11, the process goes to Step S12 in FIG. 12, and the motor 47, the unit moving solenoid 60 and the action plate moving solenoid 68 are driven on the basis of the operational conditions thus determined.

Figure 14:
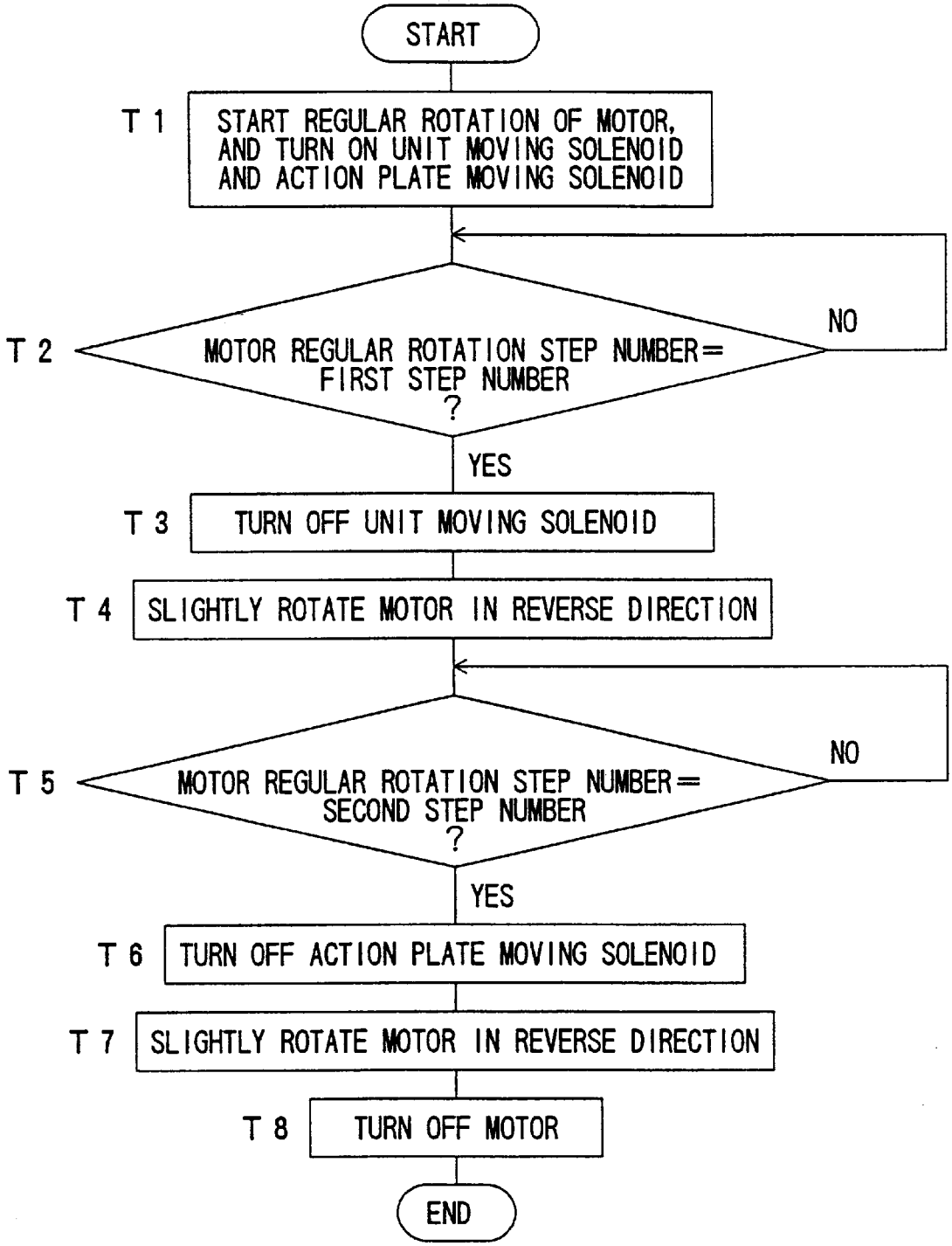
FIG. 14 is a flow chart illustrating the control operations of a motor, a unit moving solenoid and an action plate moving solenoid.

Which of the unit moving solenoid 60 and the action plate moving solenoid 68 is turned off earlier depends on the size of the document originals set in place. With reference to FIG. 14, a control operation in Step S12 will herein be described in detail on the assumption that the unit moving solenoid 60 is turned off earlier.

The unit moving solenoid 60 and the action plate moving solenoid 68 are turned on with the motor 47 rotated in the regular direction to start moving the partitioning unit 17 and the action plates 19 and 20 (Step T1). When the rotation step number of the motor 47 reaches a first step number set in Step S11 (YES in Step T2), the unit moving solenoid 60 is turned off (Step T3), so that the movement of the partitioning unit 17 is stopped. At this time, the partitioning unit 17 is located in a predetermined position corresponding to the size of the document originals set in place. In Step T4, the motor 47 is slightly rotated in the reverse direction. The reverse rotation of the motor 47 assuredly disengages the partitioning unit 17 from the motor 47.

In turn, when the rotation step number of the motor 47 reaches a second step number set in Step S11 (YES in Step T5), the action plate moving solenoid 68 is turned off (Step T6), so that the movement of the action plates 19 and 20 is stopped. At this time, the action plates 19 and 20 are located in a predetermined position corresponding to the size of the document originals set in place. After the action plate moving solenoid 68 is turned off, the motor 47 is slightly rotated in the reverse direction, so that the action plates 19 and 20 are assuredly disengaged from the motor 47 (Step T7). Then, the driving of the motor 47 is stopped in Step T8, and the process returns to the flow chart in FIG. 12.

Referring again to FIG. 12, the driving of the feed belts 11 and 12, the separator roller 21 and the separator belt 22 is started in parallel to the control operation in Step S12 to feed the first document original (the lowermost document original) from the document placing plate 8 (Step S13). Upon the completion of Step 11, the bar driving solenoid 80 is turned on to shift the partitioning bar 18 from the inactive state to the active state (Step S14).

In Step S15, it is judged whether or not the first document original fed in Step S12 is fed back onto the document placing plate 8 after being subjected to the image reading operation performed by the copying machine body 2. The judgment in Step S15 is, for example, based on the lapse of time from the start of the driving of the resist roller 25 (see FIG. 1). When the first document original is fed back onto the document placing plate 8 (see FIG. 5(*c*)) so that the branch condition in Step S15 is satisfied, the reverse rotation of the motor 47 is started, and the action plate moving solenoid 68 is turned on (Step S16). Thus, the action plates 19 and 20 are returned to their home positions.

The fact that the action plates 19 and 20 are returned to their home positions is detected on the basis of outputs of home position sensors (not shown) provided in the home positions. When the action plates 19 and 20 are returned to their home positions, the branch condition in Step S17 is satisfied, so that the action plate moving solenoid 68 is turned off (Step S18). Thereafter, the motor 47 is slightly rotated in the regular direction for the back-lash adjustment and then turned off (Step S19).

The judgment on whether or not the action plates 19 and 20 are returned to their home positions in Step S17 may be based on the reverse rotation step number of the motor 47.

Thereafter, the feeding of the subsequent document originals set on the document placing plate 8 is continued with the action plates 19 and 20 located in their home positions (see FIG. 5(*d*)). Finally, the document originals previously set in place are all fed (FIG. 5(*e*)). Thus, the document feeding operation is completed. In this embodiment, the completion of the document feeding operation is judged on the basis of the output of the set switch 14 (Step S20).

If the branch condition in Step S20 is satisfied, the process goes to Step S21 in FIG. 13, and the bar driving solenoid 80 is turned off so that the partitioning bar 18 is shifted back to the inactive state. After the counter is incremented in Step S22, it is judged whether or not the value of the counter thus incremented is equal to the number of copies inputted by the user (Step S23). That is, it is judged whether or not copies of the required number have been made. Assuming that two copies are required, for example, the branch condition in Step S23 is not satisfied because the document originals are subjected to the image reading operation only once so that only one copy is made.

If the branch condition in Step S23 is not satisfied, the process goes to Step S24, and then the motor 47 and the action plate moving solenoid 68 are driven in accordance with the operational conditions determined in Step S11. Thus, the action plates 19 and 20 are moved in the direction of the arrow 103 as shown in FIG. 5(*f*), whereby the document originals fed back onto the document placing plate 8 are transported in the direction of the arrow 103 by the action plates 19 and 20.

Then, the process returns to Step S1 in FIG. 11. When the preset switch 13 is turned on by the document originals thus transported, the driving of the feed belts 11 and 12 is started (Step S2). Thereafter, the process sequence from Step S3 to Step S7 is performed, whereby the document originals are set again in the setting position. Upon completion of the document setting, it is judged in Step S8 whether or not the value of the counter is zero. Since the count value is one at this time, the branch condition is not satisfied in Step S8 so that the process goes to Step S13 in FIG. 12.

When the feeding of the document originals is started in Step S13, the process goes to step S14. The bar driving solenoid 80 is turned on, so that the partitioning bar 18 is shifted to the active state. After the first document original is fed back onto the document placing plate 8 (Step S15), the action plates 19 and 20 are returned to their home positions (Steps S16 to S19), and the document feeding operation is continued. When it is sensed that the last document original is fed back onto the document placing plate 8 after being subjected to the second document feeding operation cycle (YES in Step S20), the bar driving solenoid 80 is turned off in Step S21 in FIG. 13. After the counter is incremented to "2" (Step S22), it is judged whether or not the value of the counter is equal to the inputted copy number (Step S23). Since it is herein assumed that the required copy number is two, the branch condition in Step S23 is satisfied and the process goes to Step S25.

In Step S25, the reverse rotation of the motor 47 is started, and the unit moving solenoid 60 is turned on. When the partitioning unit 17 is returned to its home position, the branch condition in Step S26 is satisfied so that the unit moving solenoid 60 is turned off (Step S27). Thereafter, the motor 47 is slightly rotated in the regular direction for the back-lash adjustment and then turned off (Step S28). Thus, the process ends.

The judgment on whether or not the partitioning unit 17 is returned to its home position in Step S26 may be based on an output of a home position sensor which is adapted to be turned on in response to the returning of the partitioning unit 17 to its home position or, alternatively, based on the reverse rotation step number of the motor 47.

The judgment on the feed-back of the first document original onto the document placing plate 8 in Step S15 is based on the lapse of the predetermined time period from the start of the driving of the resist roller 25. Alternatively, the judgment may be based on an output of a discharge sensor which is to be disposed adjacent to the discharge roller pair 33 and adapted to be turned on and off by passage of a document original.

While the present invention has thus been described by way of the embodiment thereof, it should be understood that the invention is not limited to this embodiment and various modifications may be made thereto within the scope and spirit of the appended claims.

What is claimed is:

1. A recycle document feeder which feeds document originals previously set in a predetermined setting position on its document placing plate one by one into its transportation path, and transports the document originals one by one through the transportation path and then back onto the document placing plate, the recycle document feeder comprising:

a partitioning unit being reciprocally movable in a document transportation direction and stopping leading edges of the document originals fed back onto the document placing plate; and an action plate being reciprocally movable in the document transportation direction and guiding, at least when a document original first transported is fed back onto the document placing plate, the document original in such a manner that a leading edge thereof is directed toward an upper side of trailing edges of document originals remaining in the predetermined setting position and, after the document originals previously set in the setting position are all fed back onto the document placing plate and a document feeding operation cycle is completed, pushing trailing edges of the document originals fed back onto the document placing plate to transport the document originals toward the predetermined setting position.

2. A recycle document feeder as set forth in claim 1, further comprising:

a common motor for driving the partitioning unit and the action plate;

a partitioning unit driving mechanism for reciprocally moving the partitioning unit in the document transportation direction;

an action plate driving mechanism for reciprocally moving the action plate in the document transportation direction; and a gear mechanism for transmitting a driving force of the common motor to the partitioning unit driving mechanism and the action plate driving mechanism in a predetermined manner.

3. A recycle document feeder as set forth in claim 2, wherein the gear mechanism comprises;

driving force switching means for permitting and interrupting transmission of the driving force of the common motor to the partitioning unit driving mechanism; and driving force switching means for permitting and interrupting transmission of the driving force of the common motor to the action plate driving mechanism.

4. A recycle document feeder as set forth in claim 3, wherein the gear mechanism further comprises a hold mechanism for holding the partitioning unit to prevent the partitioning unit from being displaced when the transmission of the driving force of the common motor to the partitioning unit driving mechanism is interrupted by the driving force switching means for the partitioning unit.

5. A recycle document feeder as set forth in claim 3, further comprising motor control means for allowing the common motor to slightly rotate in a direction opposite to a direction in which the common motor is rotated immediately before interruption of the transmission of the driving force of the common motor in response to the interruption of the transmission of the driving force of the common motor by the driving force switching means for the partitioning unit or the driving force switching means for the action plate.

6. A recycle document feeder as set forth in claim 4, further comprising motor control means for allowing the common motor to slightly rotate in a direction opposite to a direction in which the common motor is rotated immediately before interruption of the transmission of the driving force of the common motor in response to the interruption of the transmission of the driving force of the common motor by the driving force switching means for the partitioning unit or the driving force switching means for the action plate.

7. A recycle document feeder as set forth in claim 1, wherein the partitioning unit includes a partitioning bar which is shifted between an inactive state where the partitioning bar is retracted within the partitioning unit and an active state where the partitioning bar projects from the partitioning unit to stop the leading edge of the document original fed back onto the document placing plate.

8. A recycle document feeder as set forth in claim 1, further comprising:

document size sensing means for sensing a size of the document originals set in the predetermined setting position, wherein the partitioning unit is moved to a position which is determined in accordance with the document size sensed by the document size sensing means.

9. A recycle document feeder which feeds document originals previously set in a predetermined setting position on its document placing plate one by one into its transportation path, and transports the document originals one by one through the transportation path and then back onto the document placing plate, the recycle document feeder comprising:

a partitioning unit provided above the document placing plate and reciprocally movable in a document transportation direction for stopping leading edges of the document originals fed back onto the document placing plate.

10. A recycle document feeder as set forth in claim 9, wherein the partitioning unit includes a partitioning bar which is shifted between an inactive state where the partitioning bar is retracted within the partitioning unit and an active state where the partitioning bar projects from the partitioning unit to stop the leading edges of the document originals fed back onto the document placing plate.

11. A recycle document feeder as set forth in claim 10, further comprising:

document size sensing means for sensing a size of the document originals set in the predetermined setting position, wherein the partitioning unit is moved to a position which is determined in accordance with the document size sensed by the document size sensing means, when a document feeding operation is started.

12. A recycle document feeder which feeds document originals previously set in a predetermined setting position on its document placing plate one by one into its transportation path, and transports the document originals one by one through the transportation path and then back onto the document placing plate, the recycle document feeder comprising:

an action plate being reciprocally movable in a document transportation direction on the document placing plate and guiding, at least when a document original first transported is fed back onto the document placing plate, the document original in such a manner that a leading edge thereof is directed toward an upper side of trailing edges of document originals remaining in the predetermined setting position and, after a document feeding operation is completed and the document originals previously set in the setting position are all fed back onto the document placing plate, pushing trailing edges of the document originals fed back onto the document placing plate to transport the document originals toward the predetermined setting position.

13. A recycle document feeder as set forth in claim 12, wherein the action plate is of a generally right-angled triangular shape having an edge inclined upward in the document transportation direction as horizontally viewed in a direction perpendicular to the document transportation direction.

* * * * *